US012583560B2

(12) United States Patent
Wolfe et al.

(10) Patent No.: US 12,583,560 B2
(45) Date of Patent: Mar. 24, 2026

(54) FLOATING POWER GENERATION PLATFORM

(71) Applicant: MIGHTY WAVES ENERGY, LLC., Gaithersburg, MD (US)

(72) Inventors: Doug Wolfe, Gaithersburg, MD (US); Mark Hessels, Gaithersburg, MD (US)

(73) Assignee: MIGHTY WAVES ENERGY, LLC., Gaithersburg, MD (US)

( * ) Notice: Subject to any disclaimer, the term of this patent is extended or adjusted under 35 U.S.C. 154(b) by 434 days.

(21) Appl. No.: 18/315,254

(22) Filed: May 10, 2023

(65) Prior Publication Data

US 2024/0010310 A1 Jan. 11, 2024

Related U.S. Application Data

(60) Provisional application No. 63/473,927, filed on Jul. 8, 2022.

(51) Int. Cl.
*B63B 35/44* (2006.01)
*B63B 75/00* (2020.01)

(52) U.S. Cl.
CPC ..... *B63B 35/44* (2013.01); *B63B 75/00* (2020.01); *B63B 2035/446* (2013.01)

(58) Field of Classification Search
CPC .... B63B 35/44; B63B 75/00; B63B 2035/046
See application file for complete search history.

(56) References Cited

U.S. PATENT DOCUMENTS 5,876,181 A * 3/1999 Shin ..... F03D 15/10 416/111
6,244,785 B1 6/2001 Richter et al.
6,564,741 B2 5/2003 Nelson
6,935,810 B2 8/2005 Horton, III
7,242,107 B1 7/2007 Dempster
(Continued)

FOREIGN PATENT DOCUMENTS

CN 109026542 A 12/2018
GB 2538329 A * 11/2016 ..... B63B 75/00
(Continued)

OTHER PUBLICATIONS

PCT/US2023/069257; PCT Written Opinion of the International Preliminary Examining Authority mailed Jul. 29, 2024.
(Continued)

*Primary Examiner* — Marc Q Jimenez
*Assistant Examiner* — Jovon E Hayes
(74) *Attorney, Agent, or Firm* — Renner, Otto, Boisselle & Sklar, LLP

(57) ABSTRACT

A floating power generation platform includes a water plane platform having a plurality of buoyant columns, and at least one tower extending above the water plane platform. The tower is configured to support at least one first power generation system and has a center core configured for stowing a deployable member. The floating power generation platform includes a deployable spar movable between a stowed position, in which the deployable spar is stowed within the center core of the tower, and a deployed position, in which the deployable spar is extended below the water plane platform.

21 Claims, 6 Drawing Sheets

(56) References Cited

U.S. PATENT DOCUMENTS

| | | | | |
|---|---|---|---|---|
| 7,877,994 | B2 * | 2/2011 | Bull | E02B 9/08 60/497 |
| 8,689,721 | B2 * | 4/2014 | Wang | B63B 35/44 114/264 |
| 9,394,035 | B2 | 7/2016 | Dagher et al. | |
| 9,446,822 | B2 | 9/2016 | Roddier et al. | |
| 9,457,873 | B2 * | 10/2016 | Nagurny | B63B 35/44 |
| 9,592,889 | B2 | 3/2017 | Nebrera Garcia et al. | |
| 9,938,960 | B2 | 4/2018 | Gabeiras et al. | |
| 9,964,097 | B2 | 5/2018 | Dagher et al. | |
| 10,174,744 | B2 | 1/2019 | Aubault et al. | |
| 10,202,170 | B2 | 2/2019 | Dagher et al. | |
| 10,337,499 | B1 * | 7/2019 | Srinivasan | F03D 13/10 |
| 10,451,029 | B2 | 10/2019 | Bakanov et al. | |
| 10,526,056 | B1 * | 1/2020 | Hakki | F03D 1/025 |
| 10,598,155 | B2 | 3/2020 | Dagher et al. | |
| 10,626,848 | B2 | 4/2020 | Boschitsch et al. | |
| 10,890,162 | B2 | 1/2021 | Shi et al. | |
| 10,927,817 | B1 | 2/2021 | Whitehouse et al. | |
| 10,947,955 | B2 | 3/2021 | Shi et al. | |
| 10,982,654 | B1 | 4/2021 | Dehlsen et al. | |
| 11,084,558 | B2 | 8/2021 | Robinson et al. | |
| 11,208,987 | B2 | 12/2021 | Stiesdal | |
| 11,383,799 | B2 | 7/2022 | Colmard et al. | |
| 2002/0178989 | A1 | 12/2002 | Nelson | |
| 2004/0096327 | A1 | 5/2004 | Appa et al. | |
| 2010/0259050 | A1 | 10/2010 | Meller | |
| 2011/0018269 | A1 * | 1/2011 | Moser | F03D 15/00 290/55 |
| 2011/0163552 | A1 | 7/2011 | Zhang et al. | |
| 2011/0215650 | A1 | 9/2011 | Slocum et al. | |
| 2014/0091576 | A1 | 4/2014 | Wille et al. | |
| 2019/0233060 | A1 | 8/2019 | Moffat et al. | |
| 2020/0269960 | A1 * | 8/2020 | Boo | B63B 39/00 |
| 2020/0325877 | A1 * | 10/2020 | Karikomi | F03D 13/25 |
| 2020/0346719 | A1 * | 11/2020 | Baross | B63B 35/44 |
| 2021/0108612 | A1 * | 4/2021 | Foster | F03B 13/187 |
| 2021/0231105 | A1 | 7/2021 | de Souza et al. | |
| 2022/0235740 | A1 * | 7/2022 | Borø | B63B 35/44 |

FOREIGN PATENT DOCUMENTS

| | | | | |
|---|---|---|---|---|
| WO | WO-2017157399 | A1 * | 9/2017 | B63B 21/502 |
| WO | WO-2022201169 | A1 * | 9/2022 | F03D 13/25 |
| WO | WO-2022225403 | A1 * | 10/2022 | B63B 39/03 |

OTHER PUBLICATIONS

PCT/US2023/069257; PCT International Search Report and Written Opinion of the International Searching Authority mailed Apr. 8, 2024.

* cited by examiner

FLOATING POWER GENERATION PLATFORM

This application claims priority of U.S. application Ser. No. 63/473,927, filed Jul. 8, 2022, which is hereby incorporated herein by reference in its entirety.

TECHNICAL FIELD

The present disclosure relates generally to offshore power generation systems, and more particularly to a floating power generation platform.

BACKGROUND

Floating power generation is becoming increasingly critical to the future of power generation, as efforts are being made to isolate renewable energy technologies further away from sensitive environmental ecosystems near shore, such as fisheries, birds, marshes, and human development. For example, platforms supporting wind turbines and other generation technology will be used to implement such offshore power generation. Floating power generation platforms are required in water depths greater than 60 meters. Estimates are that 80% of the offshore wind market needs to be floating, and there is a significant need for a cost-effective and high-performance design of these platforms.

Current floating platform designs include semi-submersible systems that utilize ballast columns to adjust buoyancy and provide stability, spar buoys with substantial depth for stability, or tension leg platforms that rely on mooring lines to anchor the platform to the sea floor. These systems have distinct disadvantages in different phases of their deployment, operation, and retirement. Additionally, such floating designs have not achieved optimal power performance at an affordable price. Moreover, extreme offshore conditions are not typically accounted for or mitigated in these floating designs, as conventional floating power production designs retain the constraints of land-based systems and involve unnecessary complexity and cost.

SUMMARY

Accordingly, there is a need for a floating power generation platform design that minimizes structural constraints, increases the survivability of the platform in extreme conditions, and optimizes the utility of the platform. A floating power generation platform is therefore described herein that is configured to achieve each of these outcomes. For example, the floating power generation platform described herein is designed to optimize the use of available space within and on the floating power generation platform to optimize the utility and stability of the floating power generation platform during all phases of operation. As a result, performance of the floating power generation platform is increased and overall operating costs are reduced. Additionally, the floating power generation platform facilitates the rapid deployment of renewable energy technology in ocean areas where the depth ranges from a few meters to hundreds of meters.

According to an aspect of this disclosure, a floating power generation platform includes a water plane platform including a plurality of buoyant columns, at least one tower extending above the water plane platform and configured to support at least one power generation system, the at least one tower having a center core capable of hosting a stowed member, and a deployable spar movable between a stowed position, in which the deployable spar is stowed within the center core of the tower, and a deployed position, in which the deployable spar is extended below the water plane platform and each column.

According to an embodiment of at least one paragraph(s) of this disclosure, the plurality of buoyant columns are connected to each other with a plurality of struts.

According to an embodiment of at least one paragraph(s) of this disclosure the water plane platform has a rectangular structure including four buoyant columns connected to a central buoyant column.

According to an embodiment of at least one paragraph(s) of this disclosure, the deployable spar has a telescoping configuration for deployment and retraction.

According to an embodiment of at least one paragraph(s) of this disclosure, the floating power generation platform further includes a mass attached at the base of the deployable spar.

According to an embodiment of at least one paragraph(s) of this disclosure, the deployable spar is configured to host at least one second power generation system.

According to an embodiment of at least one paragraph(s) of this disclosure, the deployable spar is configured to host at least one power storage or consumption system.

According to an embodiment of at least one paragraph(s) of this disclosure, the floating power generation platform further includes one or more lines securing the deployable spar to one or more of the buoyant columns.

According to an embodiment of at least one paragraph(s) of this disclosure, the floating power generation platform further includes a lock configured to lock the deployable spar in the deployed and stowed positions.

According to an embodiment of at least one paragraph(s) of this disclosure, at least one of the plurality of buoyant columns is configured to support at least one second power generation system.

According to an embodiment of at least one paragraph(s) of this disclosure, at least one of the plurality of buoyant columns includes a plurality of segmented compartments.

According to an embodiment of at least one paragraph(s) of this disclosure, at least one of the plurality of segmented compartments includes a ballast tank.

According to an embodiment of at least one paragraph(s) of this disclosure, at least one of the plurality of segmented compartments includes a docking station for surface, subsurface, or aerial vehicles.

According to an embodiment of at least one paragraph(s) of this disclosure, the floating power generation platform further includes at least one environmental sensor.

According to an embodiment of at least one paragraph(s) of this disclosure, the floating power generation platform further includes at least one power storage battery.

According to an embodiment of at least one paragraph(s) of this disclosure, the floating power generation platform further includes a generator assembly including a mechanism configured to be driven by a plurality of blades of a wind turbine supported on the tower, a generator located below the mechanism in the tower, and a driveshaft configured to transfer energy from the mechanism to the generator to convert the energy into power.

According to an embodiment of at least one paragraph(s) of this disclosure, the generator is protected in the tower during extreme weather conditions and accommodates increased motion constraints According to an embodiment of at least one paragraph(s) of this disclosure, the nacelle placed at the top of the tower supports wind turbine blades on both the leading and trailing positions.

According to an embodiment of at least one paragraph(s) of this disclosure, the blades have varying length and numbers between the leading and trailing energy capture area.

According to an embodiment of at least one paragraph(s) of this disclosure, the mechanism is a gearbox.

According to another aspect of this disclosure, a method of deploying a floating power generation platform includes the steps of assembling the floating power generation platform near a shore, transporting the floating power generation platform to an offshore operating location, moving a deployable spar from a stowed position, in which the deployable spar is stowed within the center core of a tower of the floating power generation platform, to a deployed position, in which the deployable spar is extended below a water plane platform and each column of the floating power generation platform to a predefined operational depth, and locking the deployable spar in the deployed position.

According to an embodiment of at least one paragraph(s) of this disclosure, the method further includes the step of operating at least one power generation system supported on the floating power generation platform.

According to an embodiment of at least one paragraph(s) of this disclosure, the method further includes the step of disabling the at least one power generation system for a predetermined amount of time.

The following description and the annexed drawings set forth in detail certain illustrative embodiments described in this disclosure. These embodiments are indicative, however, of but a few of the various ways in which the principles of this disclosure may be employed. Other objects, advantages and novel features will become apparent from the following detailed description when considered in conjunction with the drawings.

BRIEF DESCRIPTION OF DRAWINGS

The annexed drawings show various aspects of the disclosure.

DETAILED DESCRIPTION

Figure 1:
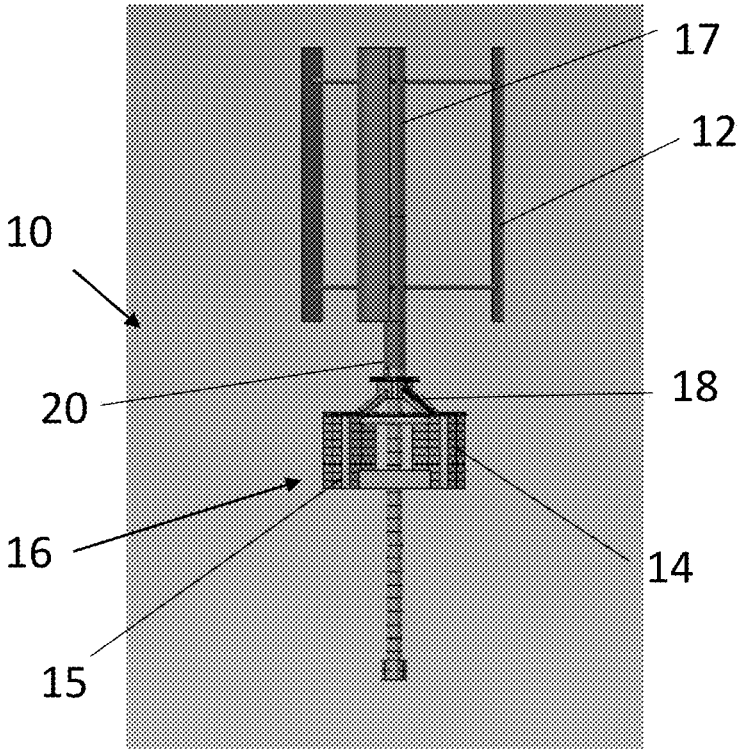
FIG. 1 is a perspective view of an exemplary floating power generation platform.
Figure 2:
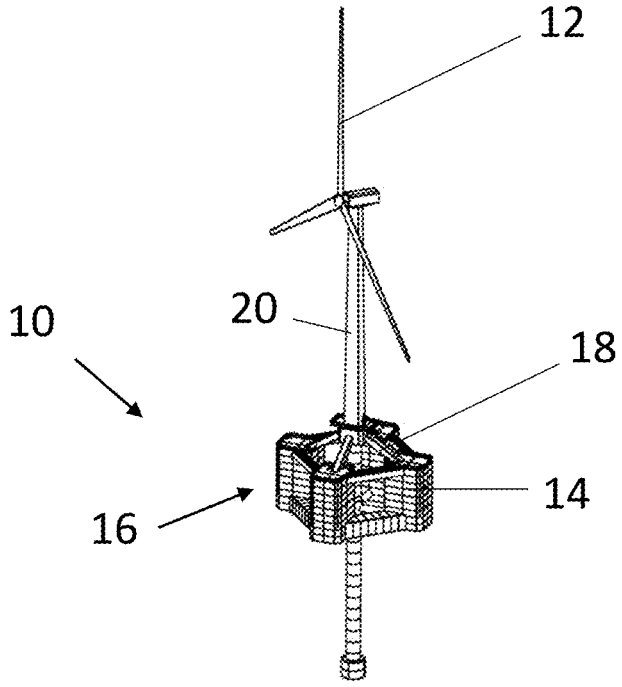
FIG. 2 is another perspective view of the exemplary floating power generation platform.

With reference to FIGS. 1 and 2, an exemplary floating power generation platform 10 is depicted. The floating power generation platform 10 is configured to be semi-submersible in a body of water and support one or more power generation systems (e.g., at least one wind turbine 12, at least one wave energy collector 15, and at least one solar energy collector 17) thereon. The floating power generation platform 10 includes a plurality of buoyant columns 14 that are attached to each other to form a water plane platform 16. For example, as depicted in the exemplary embodiment of FIG. 2, the water plane platform 16 of the floating power generation platform 10 may have a rectangular structure made of four buoyant columns 14 connected to a central structure 14. A plurality of struts 18 may connect the plurality of buoyant columns 14 with each other, such that the plurality of buoyant columns 14 and overall floating power generation platform 10 may be balanced. It is understood, however, that the water plane platform 16 may have another shaped structure and may have a different number of buoyant columns 14 and struts 18 connecting the buoyant columns 14. For example, as depicted in FIG. 1, the water plane platform 16 may include six buoyant columns 14 connected to a central buoyant column 14 with the struts 18. It is understood, however, that these are provided as non-limiting examples and that other numbers and arrangements of buoyant columns 14 and struts 18 may be applicable to the water plane platform 16 described herein, such as for example, a water plane platform 16 having two, three, five, or more than six buoyant columns 14.

The floating power generation platform 10 includes at least one tower 20 that extends above the water plane platform 16 and is configured to support at least one of the power generation systems, for example the wind turbine 12 and solar energy collector 17, as depicted. The floating power generation platform 10 and at least one tower 20 may be specifically designed to support a variety of power generation systems and wind turbine technologies, depending on which is most desirable for the location and application. For example, as depicted in FIG. 1, the floating power generation platform 10 and at least one tower 20 may be configured with the strength and stability to support a vertical axis wind turbine 12. Alternatively, as depicted in FIG. 2, the floating power generation platform 10 and at least one tower 20 may be configured with the strength and stability to support a horizontal axis wind turbine 12. It is understood, however, that the floating power generation platform 10 and at least one tower 20 may be configured to support any other type of power generation system or wind turbine technology.

Figure 3:
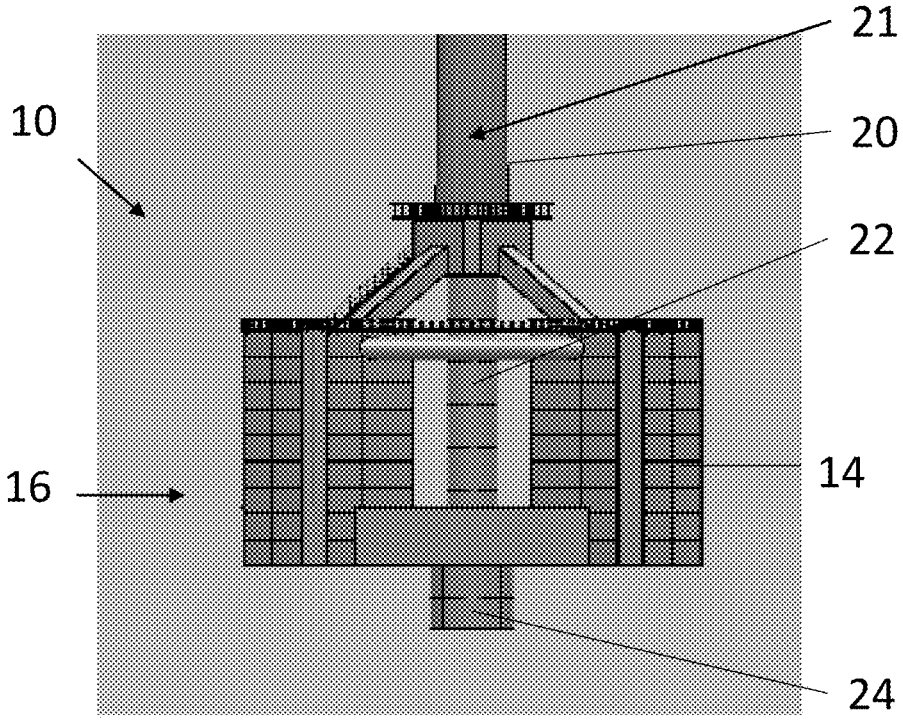
FIG. 3 is a partial side view of the exemplary floating power generation platform with a deployable spar in a stowed position.
Figure 4:
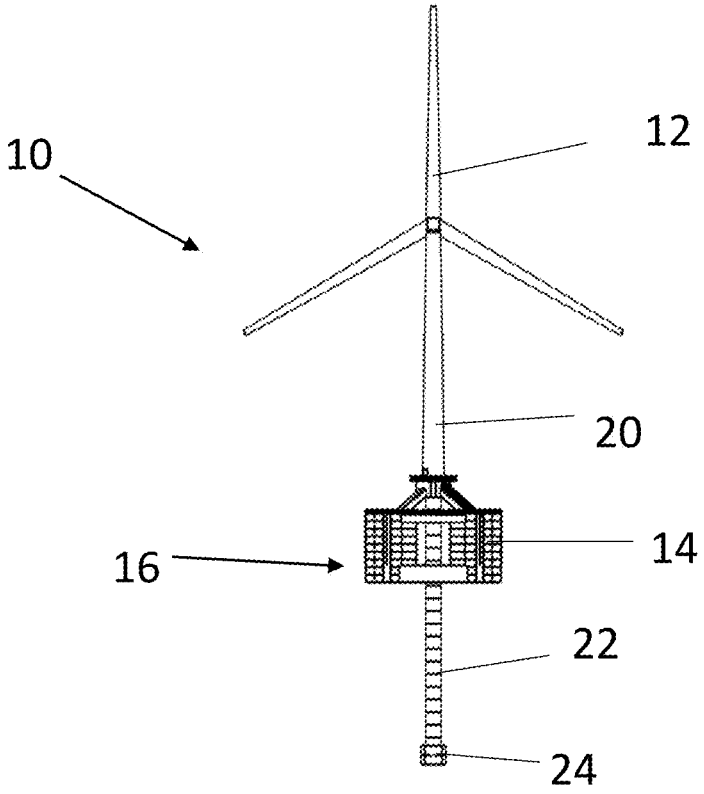
FIG. 4 is a side view of the exemplary floating power generation platform with the deployable spar in a deployed position.

As depicted in more detail in the side views of the floating power generation platform 10 in FIGS. 3 and 4, respectively, the at least one tower 20 may include a center core 21 in which a deployable spar 22 may be stowed. Specifically, when the floating power generation platform 10 is being built and transported, the deployable spar 22 may be stowed in the at least one tower 20 in a stowed position (depicted in FIG. 3). Once the floating power generation platform 10 is brought to an operational position offshore, the deployable spar 22 may be extended below the water plane platform 16 to a deployed position (depicted in FIG. 4). The deployable spar 22 may have several nested structural members that deploy to increase the depth below the platform. In the deployed position, the deployable spar 22 may extend below the water plane platform 16 and each column 14 to a predefined operational depth to create stability, especially in peak operational and storm conditions. The predefined operational depth of the deployable spar 22 may be determined based on a desired operating stability of the particular power generation systems supported on the floating power generation platform 10. For example, the predefined operational depth of the deployable spar 22 may depend on a height of the wind turbine 12 supported on the tower 20. A mass 24 may be attached at the base of the deployable spar 22 that can also act as a heave plate and be shaped to reduce motion and counteract force originating from the energy generators at or above the surface. The tower 20 and the deployable spar 22 may be configured on a single buoyant column 14, such as the center buoyant column 14, of the water plane platform 16, as depicted in FIGS. 3 and 4, or may be configured on two or more of the plurality of buoyant columns 14. For example, the floating power generation platform 10 may include a plurality of towers 20 and associated deployable spars 22, each placed respectively on one of the plurality of buoyant columns 14.

The deployable spar 22 may be configured to support or house an additional at least one power generation system, storage, or consumption features, the collective mass of which may be used for additional overall platform stabilization. For example, the deployable spar 22 may support or house power generators, such as small modular reactors, water desalination systems, and/or hydrogen generators, and may additionally or alternatively house energy storage, such as one or more batteries, and/or energy consuming systems such as computing servers. Various computing systems housed in the deployable spar 22 may, for example, facilitate the interconnection of the floating power generation platform 10 with other floating power generation platforms in an offshore floating wind farm. The mass of the additional systems provided in or on the deployable spar 22, for example at a bottom thereof or along a length thereof, serves to counterbalance the weight and forces of the wind turbine 12. The shape of the deployable spar 22 may be optimized for housing utility functions and for counteracting the forces at the top of the wind turbine 12. The exact shape and cross-section of the deployable spar 22 may be designed specifically for the operational location and the desired functions of the floating power generation platform 10.

A plurality of flexible lines, such as chains or anchor lines, may secure the deployable spar 22 to each of the plurality of columns 14. A length of each of the flexible lines may be such that each of the flexible lines are under tension when the deployable spar 22 is fully extended. Therefore, as the floating power generation platform 10 undergoes motion, the flexible lines will be in tension on the compensating side of the sparse water plane platform 16 and minimize the relative motion between the deployable spar 22 and the plurality of columns 14. A lock may be provided for rigidly locking the deployable spar 22 in a fully extended position.

Each of the plurality of buoyant columns 14 may be cylindrical or rectangular in shape, as depicted in FIGS. 1 and 2. Alternatively, each of the plurality of buoyant columns 14 may be a different shape, such as polygonal (e.g., rectangular). The outer surface of each of the plurality of buoyant columns 14 may be tapered to provide more buoyancy lower in each column. Also, each of the plurality of buoyant columns 14 may have different shapes than each other. The primary purpose of the plurality of buoyant columns 14 is to achieve buoyancy and stability of the floating power generation platform 10 and adjust buoyancy based on the operating location.

In addition to providing buoyancy and stability to the floating power generation platform 10, the plurality of buoyant columns 14 may also be configured to support or house additional useful functions and systems that enhance the utility of the floating power generation platform 10. For example, at least one of the plurality of buoyant columns 14 may be configured to support at least one wave energy collector 15 and/or at least one solar energy collector 17. It will be understood, however, that the at least one wave energy collector 15 and/or the at least one solar energy collector 17 may be supported on another part of the floating power generation platform 10, such as the deployable spar 22, the tower 20, the struts 18, and/or the wind turbine 12. The at least one wave energy collector 15 and/or the at least one solar energy collector 17 adds to the overall utility of the floating power generation platform 10 and improves the baseload performance thereof, while additionally providing additional stability to the structure during operations upon action of counter forces that tilt the floating power generation platform 10. The wave energy collector 15 may drive a mechanism housed internal to at least one of the buoyant columns 14 and is configured to collect energy in the rise and fall of the ocean waves, as well as in the vertical motion of the floating power generation platform 10, as a whole. The solar energy collector 17 also adds to the baseload performance of the floating power generation platform 10 and may serve to keep the batteries charged to the maximum extent possible. Various other systems, such as energy storage and data processing systems, may be housed in or supported by the plurality of buoyant columns 14.

Figure 5:
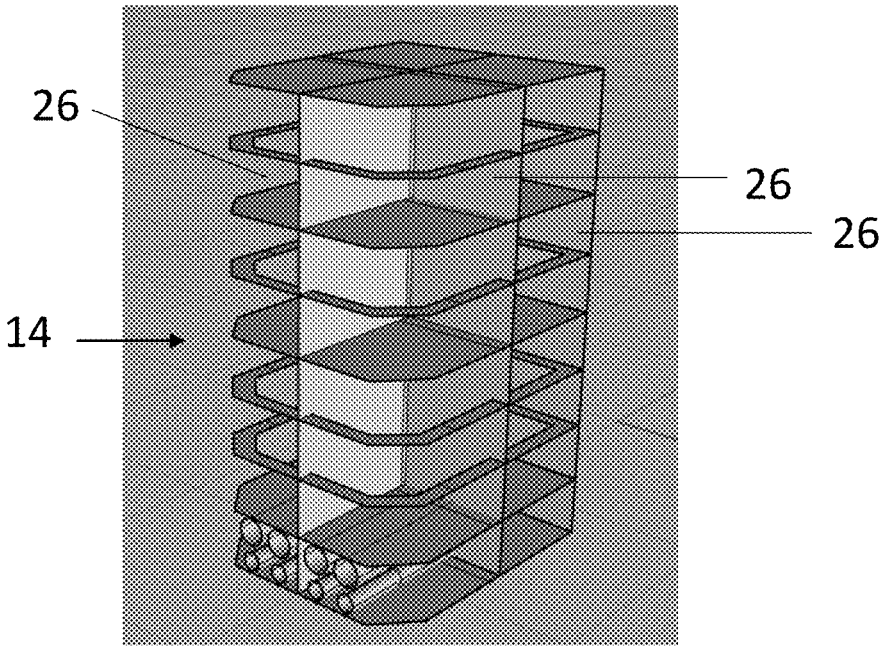
FIG. 5 is a cut-away perspective view of an exemplary buoyant column of the exemplary floating power generation platform.
Figure 6:
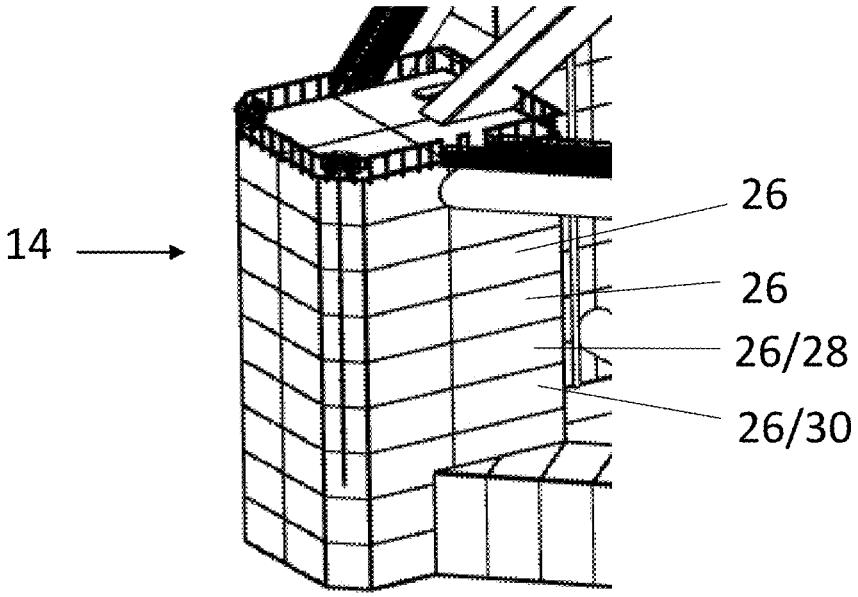
FIG. 6 is a perspective view of the exemplary buoyant column of the exemplary floating power generation platform.

With reference to FIGS. 5 and 6, the inner structure of at least one of the buoyant columns 14 includes a plurality of segmented compartments 26 to provide space for a range of different payloads and functions. For example, at least one of the compartments 26 may be a ballast tank 28 to provide the primary purpose of the plurality of buoyant columns 14 of providing buoyancy and stability of the floating power generation platform 10. At least one of the compartments 26 may also provide a docking station 30 for an underwater, surface, or aerial vehicle. Other systems that may be provided in one or more of the compartments 26 may be, for example, an interface for wave energy collection and conversion, offshore aquaculture systems, power interfaces, battery storage systems, data processing systems, and remote sensing systems. At least one of the compartments 26 of the buoyant columns 14 may have doors and/or panels on the top and/or sides of the buoyant column 14 that can be deployed to expose the various systems housed within to the external air or water. Each of the plurality of buoyant columns 14 may have compartments 26 that serve a similar or complimentary purpose, or may have compartments 26 that carry out different functions that enhance the utility of the platform. Each of the plurality of buoyant columns 14 may be equipped with standard electrical and energy storage interfaces.

The floating power generation platform 10 may additionally include a variety of environmental sensors, and at least one power storage battery that enables sensor operations for a period of time in the event that power generation is limited. The at least one power storage battery will also power on board sensor data processing computers.

Figure 7:
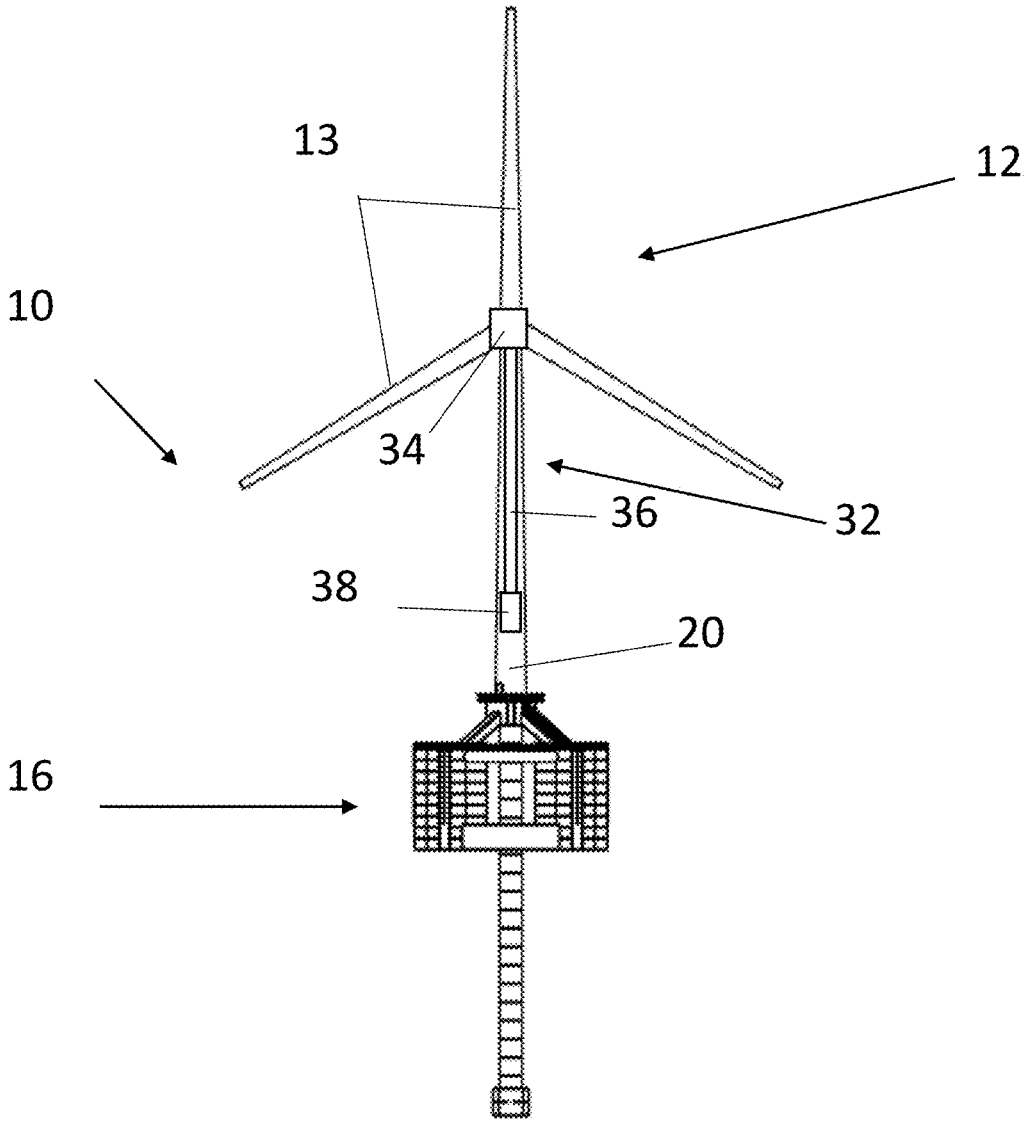
FIG. 7 is a schematic diagram of an exemplary generator assembly in a side view of the exemplary floating power generation platform.

Turning to FIG. 7, the floating power generation platform 10 includes a generator assembly 32 that is configured such that the mass of the wind turbine 12 and the energy conversion thereof is not entirely at the top of the tower 20.

Specifically, the generator assembly 32 may include a mechanism 34 (e.g., a sprocket or gearbox) that is driven by a plurality of blades 13 of the wind turbine 12. Energy from the mechanism is transferred with a flexible belt or chain connected to a fixed driveshaft 36 to a generator 38 (i.e., an energy conversion device). Energy may also be transferred through compressed fluids. For example, a right-angle gearbox mechanism 34 may be rotated to align the blades 13 with the wind direction and may be configured to transfer the horizontal axis of rotation of the turbine blades 13 into vertical axis rotation and then the driveshaft 36 may be deployed to connect to the generator 38 located lower in the tower 20. For a sprocket mechanism 34, the wind turbine 12 may rotate based on wind direction. The generator 38 may be located in a bottom of the tower 20 or may be located in a middle portion of the tower 20 between the bottom of the tower 20 and the top of the tower 20, as depicted in FIG. 7. The generator 38 is located lower in the tower than the wind turbine 12 and mechanism 34, such that the survivability of the generator 38 is increased and the overall center of gravity of the floating power generation platform 10 is lowered to create greater stability of the floating power generation platform 10 when deployed and in peak storm conditions. In another embodiment, however, the generator 38 may be directly driven by the plurality of blades 13.

Figure 8A:
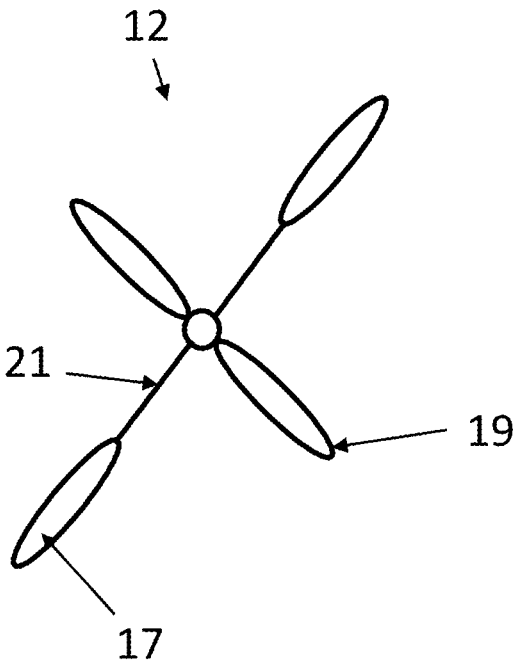
FIGS. 8A and 8B illustrate a schematic diagram of a blade and spoke configuration for a wind turbine.
Figure 8B:
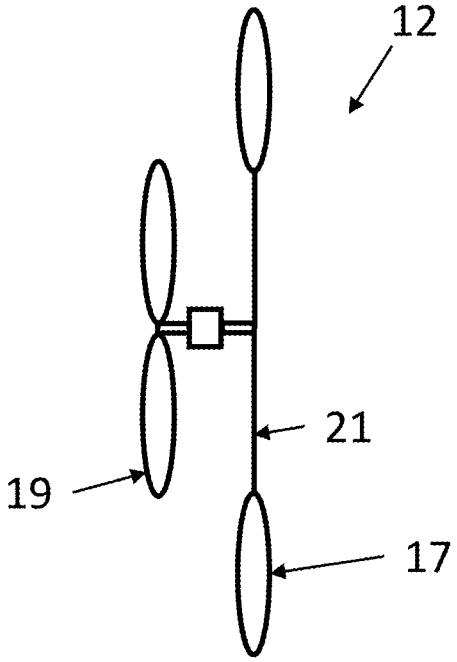

As depicted in FIGS. 8A and 8B, the wind turbine 12 may include two sets of blades 13, including an upwind set of blades 17 and a downwind set of blades 19 located on an opposite side of the tower 12 as the upwind set of blades 17. The blades 13 and the generator 38 are configured to be rotatable into the wind direction based on sensors and an independent set of rotational gears. The wind turbine 12 may include a nacelle with a hub and pitch control for the blades 13 to adjust the upwind set of blades 17 and the downwind set of blades 19 based on wind strength and direction. Having two sets of blades, for example, may also balance the wind turbine 12 and keep the horizontal center of gravity of the nacelle over the top of the tower 20.

The number of blades 13 in both the upwind set of blades 17 and the downwind set of blades 19 may be optimized based on weight, cost and performance parameters of the wind turbine 12. For example, as shown in FIGS. 8A and 8B, there may be two blades 13 in both the upwind set of blades 17 and the downwind set of blades 19. Alternatively, there may be three blades 13 in both the upwind set of blades 17 and the downwind set of blades 19. Alternatively, there may be four or more blades 13 in both the upwind set of blades 17 and the downwind set of blades 19. Further, there may be a different number of blades 13 in each of the upwind set of blades 17 and the downwind set of blades 19. For example, there may be three blades 13 in the upwind set of blades 17 and two blades 13 in the downwind set of blades 19.

To achieve a larger swept area, the plurality of blades 13 in either the upwind set of blades 17 or the downwind set of blades 19 may be extended past an outer radius of the swept area of the respective downwind set of blades 19 or the upwind set of blades 17. For example, as shown in FIGS. 8A and 8B, the plurality of blades 13 in either the upwind set of blades 17 or the downwind set of blades 19 may be attached to spokes 21 that extend to the outer radius of the swept area of the respective downwind set of blades 19 or the upwind set of blades 17. In this way, an overall swept area of the plurality of blades 13 can be achieved without having to produce blades 13 extending the full radius of the overall swept area.

Figure 9:
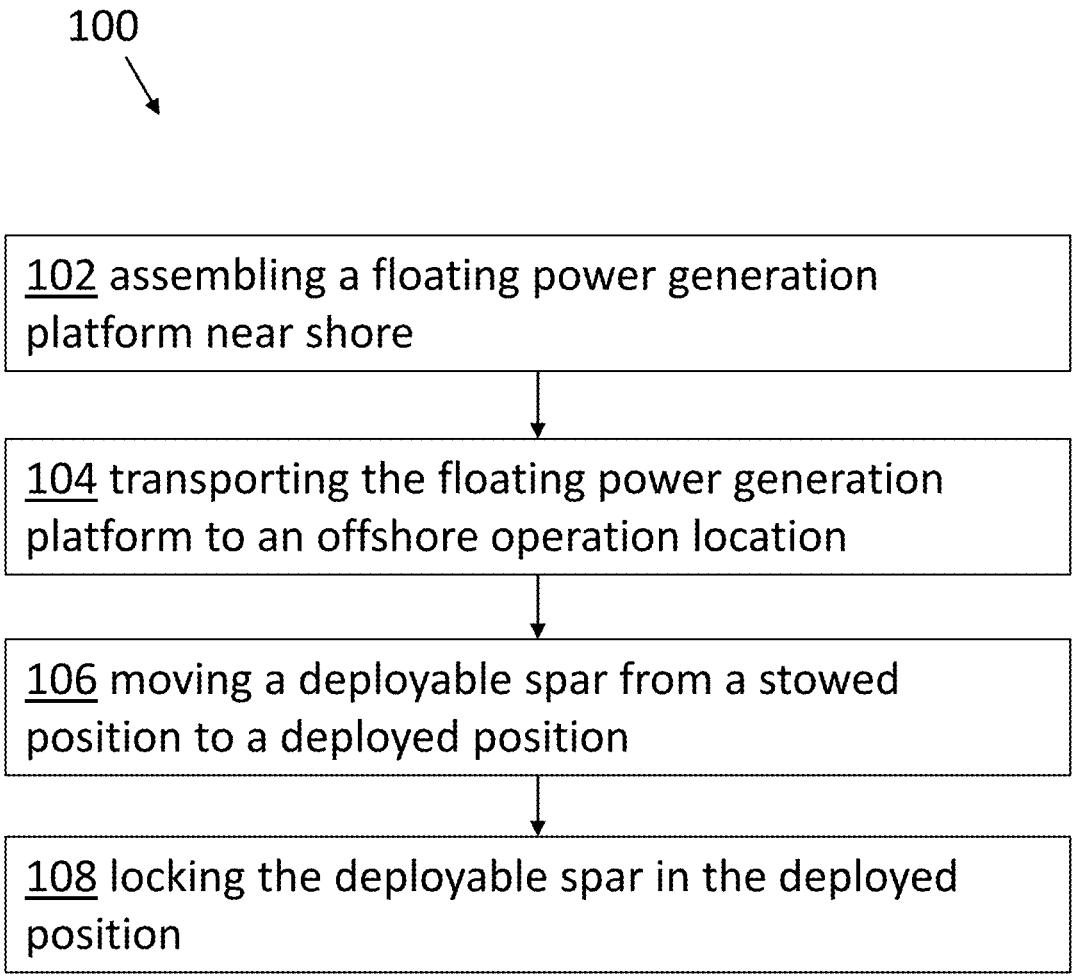
FIG. 9 is a flowchart of a method of deploying a floating power generation platform.

Turning to FIG. 9, a method of deploying the floating power generation platform 10 described above will be descripted. The method 100 includes a step 102 of assembling the floating power generation platform 10 near shore and close to a dock. During assembly, the deployable spar 22 is stowed in the hollow center of the tower 20, as described above. The method 100 then includes a step 104 of transporting the floating power generation platform 10 to an offshore operating location. The step 104 of transporting may include, for example, towing the floating power generation platform 10 with a boat. Once the floating power generation platform 10 is transported to the offshore operating location, the method 100 includes the step 106 of moving the deployable spar 22 from the stowed position, in the hollow center of the tower 20, to the deployed position, extended downward from the water plane platform 16 to a predetermined operational depth to achieve overall structural stability. The method 100 then includes a step 108 of locking the deployable spar 22 in the deployed position with the lock. The method 100 may then include operating the power generation systems on the floating power generation platform 10, and if necessary under extreme weather conditions, disabling the power generation systems and/or placing the power generation systems in a survival mode for a predetermined amount of time or until the extreme weather conditions subside.

For retrieval of the floating power generation platform 10, the power generation systems may be disabled and the deployable spar may be unlocked and moved back to the stowed position. The floating power generation platform 10 may then be transported back to shore for repair or retirement.

The floating power generation platform 10 described herein achieves symmetry of operation as forces in any direction result in nearly the same response from the energy collectors and the platform motions. The structure is designed to eliminate the need for complex active damping mechanisms that limit operational life and are a single point of failure. That is, the ease of deployment and flexibility in operations reduces complexity and cost, eliminates the need for active stability control systems, and eliminates costly specialized deployment platforms.

Although the above disclosure has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments. In addition, while a particular feature may have been described above with respect to only one or more of several illustrated embodiments, such feature may be combined with one or more other features of the other embodiments, as may be desired and advantageous for any given or particular application.

What is claimed is:

1. A floating power generation platform comprising:

a water plane platform including a plurality of buoyant columns;

at least one tower extending above the water plane platform and configured to support at least one power generation system, the at least one tower having a center core capable of hosting a stowed member; and a deployable spar, as the stowed member, movable between a stowed position, in which the deployable spar is stowed within the center core of the tower, and a deployed position, in which the deployable spar is extended below the water plane platform and each column;

wherein the deployable spar is configured to host one or more of at least one second power generation system, at least one power storage system, and at least one power consumption system within the deployable spar.

2. The floating power generation platform according to claim 1, wherein the plurality of buoyant columns are connected to each other with a plurality of struts.

3. The floating power generation platform according to claim 1, wherein the water plane platform has a rectangular structure including four buoyant columns connected to a central buoyant column.

4. The floating power generation platform according to claim 1, wherein the deployable spar has a telescoping configuration for deployment and retraction.

5. The floating power generation platform according to claim 1, further comprising a mass attached at the base of the deployable spar.

6. The floating power generation platform according to claim 1, wherein the deployable spar is shaped to resist motion and counteract forces originating from the energy generators at or above the surface.

7. The floating power generation platform according to claim 1, further comprising a lock configured to lock the deployable spar in the deployed and stowed positions.

8. The floating power generation platform according to claim 1, wherein at least one of the plurality of buoyant columns is configured to support at least one second power generation system.

9. The floating power generation platform according to claim 1, wherein at least one of the plurality of buoyant columns includes a plurality of segmented compartments.

10. The floating power generation platform according to claim 9, wherein at least one of the plurality of segmented compartments includes a ballast tank.

11. The floating power generation platform according to claim 9, wherein at least one of the plurality of segmented compartments includes a docking station for surface, subsurface, or aerial vehicles.

12. The floating power generation platform according to claim 1, further comprising at least one environmental sensor.

13. The floating power generation platform according to claim 1, further comprising at least one power storage battery.

14. The floating power generation platform according to claim 1, further comprising a generator assembly including:

a mechanism configured to be driven by a plurality of blades of a wind turbine supported on the tower;

a generator located below the mechanism in the tower; and a driveshaft configured to transfer energy from the mechanism to the generator to convert the energy into power.

15. The floating power generation platform according to claim 14, wherein the generator is protected in the tower during extreme weather conditions and accommodates increased motion constraints.

16. The floating power generation platform according to claim 14, wherein the nacelle placed at the top of the tower supports wind turbine blades on both the leading and trailing positions.

17. The floating power generation platform according to claim 14, wherein the blades have varying length and numbers between the leading and trailing energy capture area.

18. The floating power generation platform according to claim 14, wherein the mechanism is a gearbox.

19. A method of deploying a floating power generation platform, the method comprising the steps of:

assembling the floating power generation platform near a shore, including stowing a deployable spar in a hollow center core of a tower of the floating power generation platform, the deployable spar being configured to host one or more of at least one power generation system, at least one power storage system and at least one power consumption system within the deployable spar;

transporting the floating power generation platform to an offshore operating location;

moving the deployable spar from a stowed position, in which the deployable spar is stowed within the center core of the tower of the floating power generation platform, to a deployed position, in which the deployable spar is extended below a water plane platform and each column of the floating power generation platform to a predefined operational depth;

locking the deployable spar in the deployed position.

20. The method according to claim 19, further comprising the step of operating at least one power generation system supported on the floating power generation platform.

21. The method according to claim 19, further comprising the step of disabling the at least one power generation system for a predetermined amount of time.

* * * * *